US008336351B2

(12) United States Patent
Handel et al.

(10) Patent No.: US 8,336,351 B2
(45) Date of Patent: Dec. 25, 2012

(54) APPARATUS AND METHODS THAT APPLY A PRESS FORCE INCLUDING A SEPARATELY APPLIED CORE CRIMP FORCE

(75) Inventors: Jeffrey M. Handel, Warren, OH (US); John Raymond Metzger, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 810 days.

(21) Appl. No.: 12/477,237

(22) Filed: Jun. 3, 2009

(65) Prior Publication Data

US 2010/0307212 A1 Dec. 9, 2010

(51) Int. Cl.
*B21C 51/00* (2006.01)

(52) U.S. Cl. ..... 72/21.4; 72/712

(58) Field of Classification Search ..... 72/20.1, 72/20.2, 21.4, 412, 416, 712; 29/862, 863, 29/882

See application file for complete search history.

(56) References Cited

U.S. PATENT DOCUMENTS 5,101,651 A 4/1992 Yeomans
6,212,924 B1 * 4/2001 Meisser ..... 72/21.4
6,301,777 B1 * 10/2001 Sigler et al. ..... 29/753

* cited by examiner

*Primary Examiner* — Teresa M Ekiert
(74) *Attorney, Agent, or Firm* — Thomas N. Twomey

(57) ABSTRACT

A crimping apparatus and methods are provided that apply a press force and a part of the press force is separately applied as a core crimp force for crimping a terminal to a wire conductor. A die assembly includes a die defining a cavity that includes an independently moveable core plate and a ram assembly includes a ram in force connection with a load pin and a core plate. When the ram applies the press force, the core crimp force will be separately applied from the ram through the load pin and core plate to produce a core crimp portion that connects the wire conductor to the terminal. The applied core crimp force is subsequently transferred from the core crimp portion to the core plate to the load pin and into the ram.

20 Claims, 6 Drawing Sheets

APPARATUS AND METHODS THAT APPLY A PRESS FORCE INCLUDING A SEPARATELY APPLIED CORE CRIMP FORCE

TECHNICAL FIELD

This invention relates to a crimping apparatus and methods for applying a press force and a part of the press force is separately applied as a core crimp force, more particularly, a crimping apparatus applies a press force and a part of the press force is applied separately as a core crimp force that is applied from a ram to a load pin to an independently moving core plate to produce a core crimp portion that connects the terminal to the wire conductor, and the applied core crimp force is transferred from the core crimp portion to a core plate to a load pin and into the ram.

BACKGROUND OF INVENTION

It is known, according to prior art U.S. Pat. No. 5,101,651 issued on Apr. 7, 1992 and referring to FIG. 1, that a terminal applicator 1 applies a crimp force, transmitted from a ram 3 through a crimping bar 2 securely attached to a ram 3 to a wire conductor disposed in a terminal on an anvil 5 attached to a base 6. A majority portion of the applied crimp force is retransmitted back through the crimping bar 2 to a cantilevered member 4 where the majority portion of the crimp force is measured. A minority portion of the applied crimp force transmitted into the ram 3 and is not measured.

It is also known to measure a press force applied by the die press during the crimping cycle to assess the quality of a core crimp portion that connects a wire conductor to a terminal. The press force includes a force component known as the core crimp force that is needed to produce a core crimp portion that crimps a terminal to an exposed portion of the wire conductor during the crimping cycle. Measurement of the press force does not allow a consistent, reliable quality decision regarding the core crimp portion to be rendered, especially for a size of wire conductor of less then or equal to 20 gauge connected to a corresponding terminal.

It is desirable to render a consistent, reliable quality decision regarding the core crimp portion produced after the core crimp force is applied during the crimping cycle, especially for a terminal crimped to a size of wire conductor of less then or equal to 20 gauge. For example, the quality defects of a wire strand missing in the core crimp portion and wire insulation contained in the core crimp portion are important to detect to ensure that the mechanical and electrical integrity of the crimp connection of the terminal to the wire conductor is not impaired. Because smaller gauge wire of less than 20 gauge includes wire strands having a smaller cross sectional area than similar strands of larger gauge wire, detecting the quality defect of a strand of wire conductor missing from the core crimp portion becomes increasingly difficult. An undetected core crimp portion that is defective may produce an undesired effect of downstream quality issues when the terminal connected to the wire conductor is manufactured into a wiring harness.

Therefore, what is needed is a crimping apparatus that is configured to apply a core crimp force to produce a reliable core crimp portion and render a quality decision that accurately reflects the quality of the produced core crimp portion during the crimping cycle, especially for a terminal crimped to a size of wire conductor of less then or equal to 20 gauge.

SUMMARY OF THE INVENTION

Analysis of an applied core crimp force that produces a reliable core crimp portion connecting the terminal to the wire conductor is found to be a suitable quality indicator for detecting the defects of a missing wire conductor strand contained in the core crimp portion and wire insulation contained in the core crimp portion, especially for smaller gauge wire having a size of less than 20 gauge connected to a corresponding terminal. Because the applied core crimp force is a suitable quality indicator of core crimp portion defects, it is desirable to apply and sense the actual core crimp force that produces the core crimp portion apart, or separate from, the applied press force of the die press and the remaining force components that are derived from the applied press force during the crimping cycle.

In accordance with one embodiment of the invention, a crimping apparatus includes a die assembly. The die assembly includes a die defining a cavity and the cavity includes a core plate having independent movement within the cavity. The core plate includes a first core plate end and a second core plate end remote from the first core plate end. The crimping apparatus includes a ram assembly for applying a press force to the die assembly. The ram assembly includes a ram and a load pin being in force connection with the ram. The load pin has a first pin end and a second pin end remote from the first pin end. The first pin end is proximate to the ram and the second pin end extends away remote from the ram assembly into the die assembly being proximate to the first core plate end. The load pin is in force connection with the core plate. A wire conductor is disposed in a terminal located on a terminal plate pad in the crimping apparatus proximate to the second core plate end. The press force will be applied by the ram and the load pin will engage the first core plate end and the second core plate end will engage the terminal plate pad and the wire conductor disposed in the terminal therebetween. A part of the press force will be separately applied as a core crimp force and produce a core crimp portion that connects the terminal to the wire conductor and the applied core crimp force is transferred from the core crimp portion to the core plate to the load pin into the ram.

In accordance with another embodiment of the invention, a method of applying a press force includes the step of providing a crimping apparatus configured to apply a press force. A part of the press force is applied separately as a core crimp force. A further step includes providing the wire conductor disposed in the terminal to the crimping apparatus. Yet a further step includes applying the core crimp force to the wire conductor disposed in the terminal producing a core crimp portion that connects the terminal to the wire conductor.

In accordance with yet a further embodiment of the invention, a manufacturing process method for connecting a wire conductor to a terminal includes the step of providing the wire conductor and the terminal. A further step in the method is disposing the wire conductor in the terminal. An additional step is applying a press force, and a part of the press force is separately applied as a core crimp force producing a core crimp portion connecting the terminal to the wire conductor. A further step is sensing the applied core crimp force. The method also includes measuring the sensed core crimp force. Yet a further step includes evaluating a measurement of the core crimp force to render a quality decision on the core crimp portion.

BRIEF DESCRIPTION OF THE DRAWINGS

This invention will be further described with reference to the accompanying drawings in which.

DETAILED DESCRIPTION OF THE PREFERRED EMBODIMENT

Figure 1:
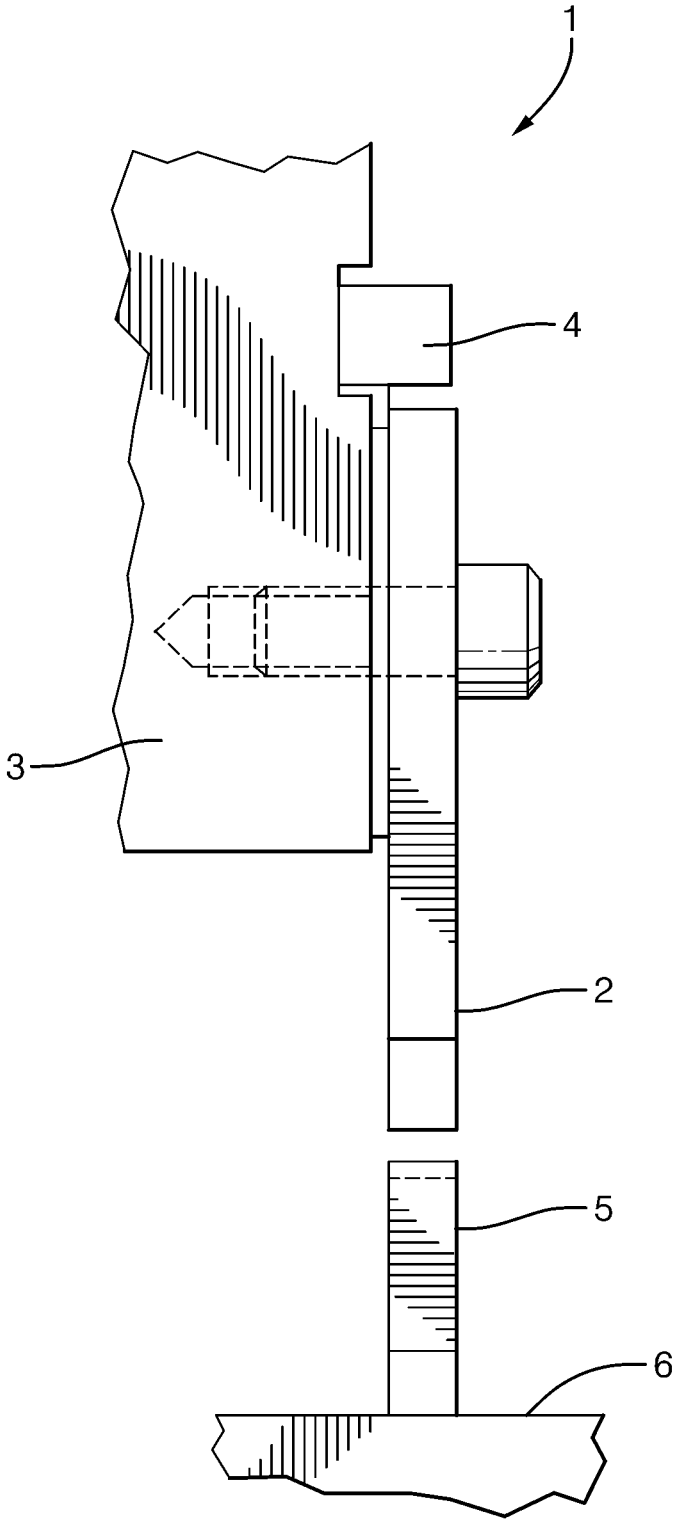
PRIOR ART FIG. 1
FIG. 1 is a cross section view of a prior art crimping mechanism having a crimping bar attached to a ram for applying a force to crimp a terminal to a wire.

In accordance with a preferred embodiment of this invention, referring to FIGS. 2-4A, a crimping apparatus 10 applies a press force and a part of a press force is separately applied as a core crimp force to produce a core crimp portion (not shown) that crimps, or connects a terminal 12 to a wire conductor 14.

Crimping is generally known as joining two pieces of metal or other malleable material by deforming one or both materials to hold the other. The bend or deformity in the metal or other malleable material is generally known as a crimp. A terminal generally includes any device attached to a wire conductor that facilitates connection with another conductor. According to the embodiment shown in FIGS. 2-4A, the terminal holds and connects with the wire conductor by a crimp producing the core crimp portion to make a lasting electrical connection. The lasting electrical connection is electrically connected through the wire conductor with some other point remote from the lasting electrical connection such as is common in a wiring harness.

Prior to the application of the press force by the apparatus, the wire conductor and terminal are provided to the apparatus. Typically, the terminal is provided to the apparatus on a wire frame. Terminal 12 includes a first terminal portion 16 and a second terminal portion 18. Wire conductor 14 includes an exposed wire portion 20 and an insulated wire portion 22. Insulated wire portion 22 has wire insulation disposed surrounding wire conductor 14. Exposed wire portion 20 is disposed in first terminal portion 16 and insulated wire portion 22 is disposed in the second terminal portion 18. With application of the press force, an insulation crimp portion is produced by an insulation crimp force at insulated wire portion 22 disposed in second terminal portion 18. A part of the press force separately applied as the core crimp force produces core crimp portion of the exposed wire portion 20 disposed in first terminal portion 16. It should be understood the core crimp portion and the insulation crimp portion are formed within the terminal and are hidden from view in the FIGS. 2-4A.

The press force is the total force applied by the ram assembly to the die assembly of the apparatus. Several main force components make up the press force. A first main force component is the core crimp force applied to crimp the exposed wire portion is disposed in first terminal portion. A second main force component is the insulation crimp force to crimp the insulated wire portion disposed in the second terminal portion. A third main force component is the force applied to a terminal cut-off punch where the terminal is cut free from the wire frame after the crimping cycle. The forth main component force is the force applied to the terminal pad where the uncrimped terminal disposed in the wire conductor lie in the die press. Because the apparatus creates large forces when the press force is applied, it is desirable to securely support the apparatus to facilitate controlled movements and forces during the crimping process. This can be achieved, for instance, by securely mounting the apparatus to the floor.

Apparatus 10 is constructed in a manner to be able to sustain repeated applications of a press force and is typically constructed of metal, preferably steel. Apparatus 10 includes a die assembly 24 and a ram assembly 26 opposed to the die assembly 24.

Figure 2:
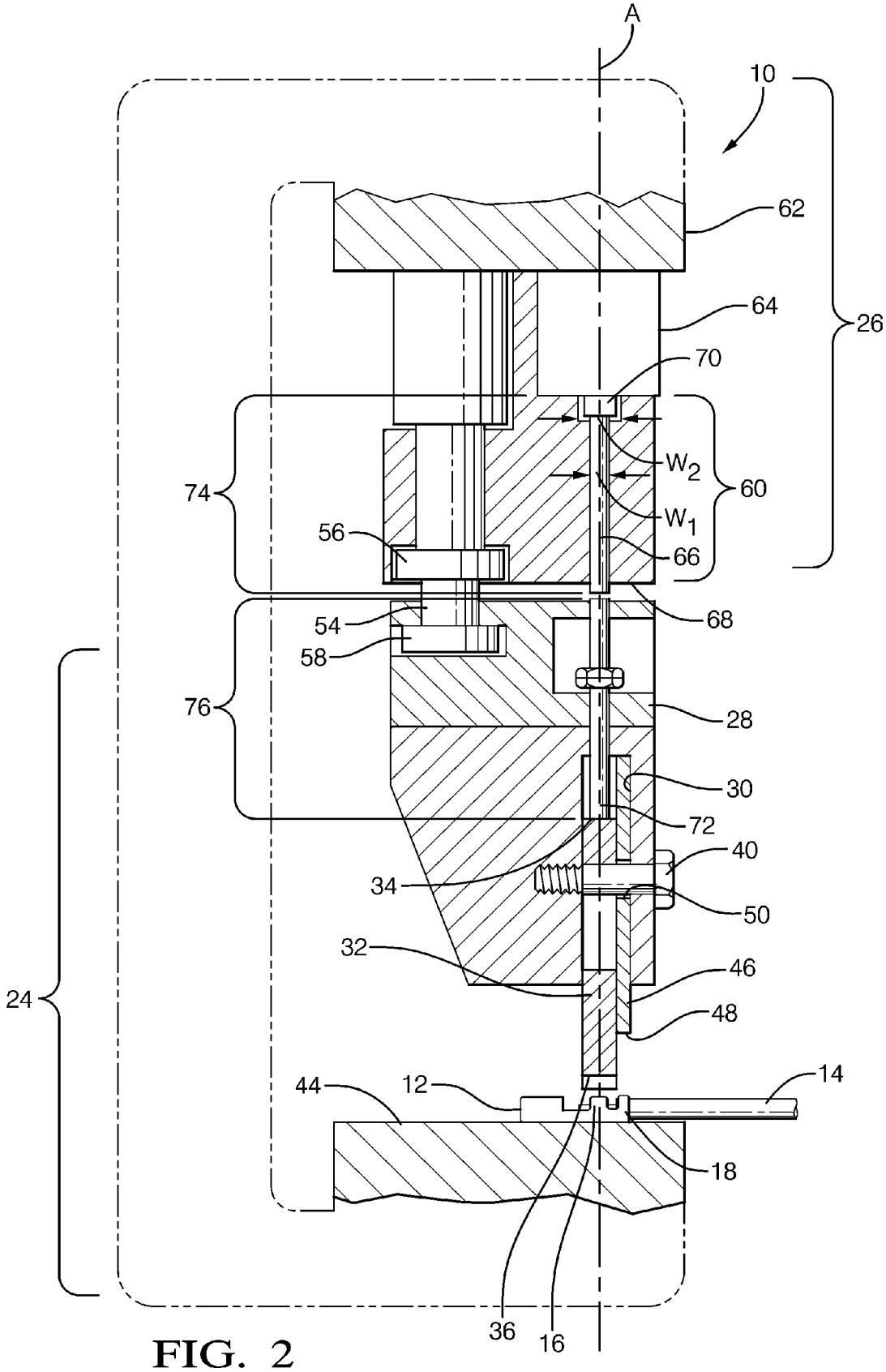
FIG. 2 shows a cross section view of a crimping apparatus with a press force not applied, in accordance with the invention.
Figure 5:
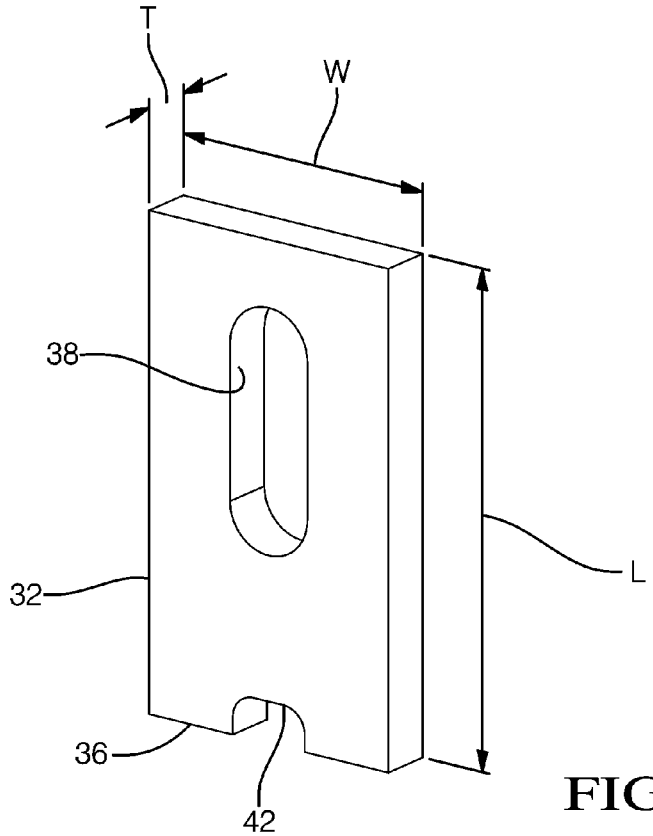
FIG. 5 shows a perspective view of the core crimp plate of the crimping apparatus in FIG. 2.

Referring to FIGS. 2 and 5, die assembly 24 includes a die 28. Die 28 defines a cavity 30 that includes a core plate 32. Core plate 32 has a width W, a length L, and a thickness T, and the length is greater then the width and the thickness. Core plate 32 is sized to about fit cavity 30 along width W and thickness T. The thickness of the core plate is dependent on the size of the wire conductor being crimped to a corresponding terminal and typically increases in thickness as the size of the terminal and the size of the wire gauge increases. Typically, a thickness T of the core plate used with wire conductors having a size of less than 20 gauge is about 3 millimeters. Core plate 32 has a first core plate end 34 and a second core plate end 36 remote from first core plate end 34.

Typically, a corresponding terminal for a wire conductor is suitably designed to cover a corresponding two gauge size range. For example, a corresponding 20 gauge terminal may be used to connect to a 20 or 22 gauge wire conductor.

Figure 3:
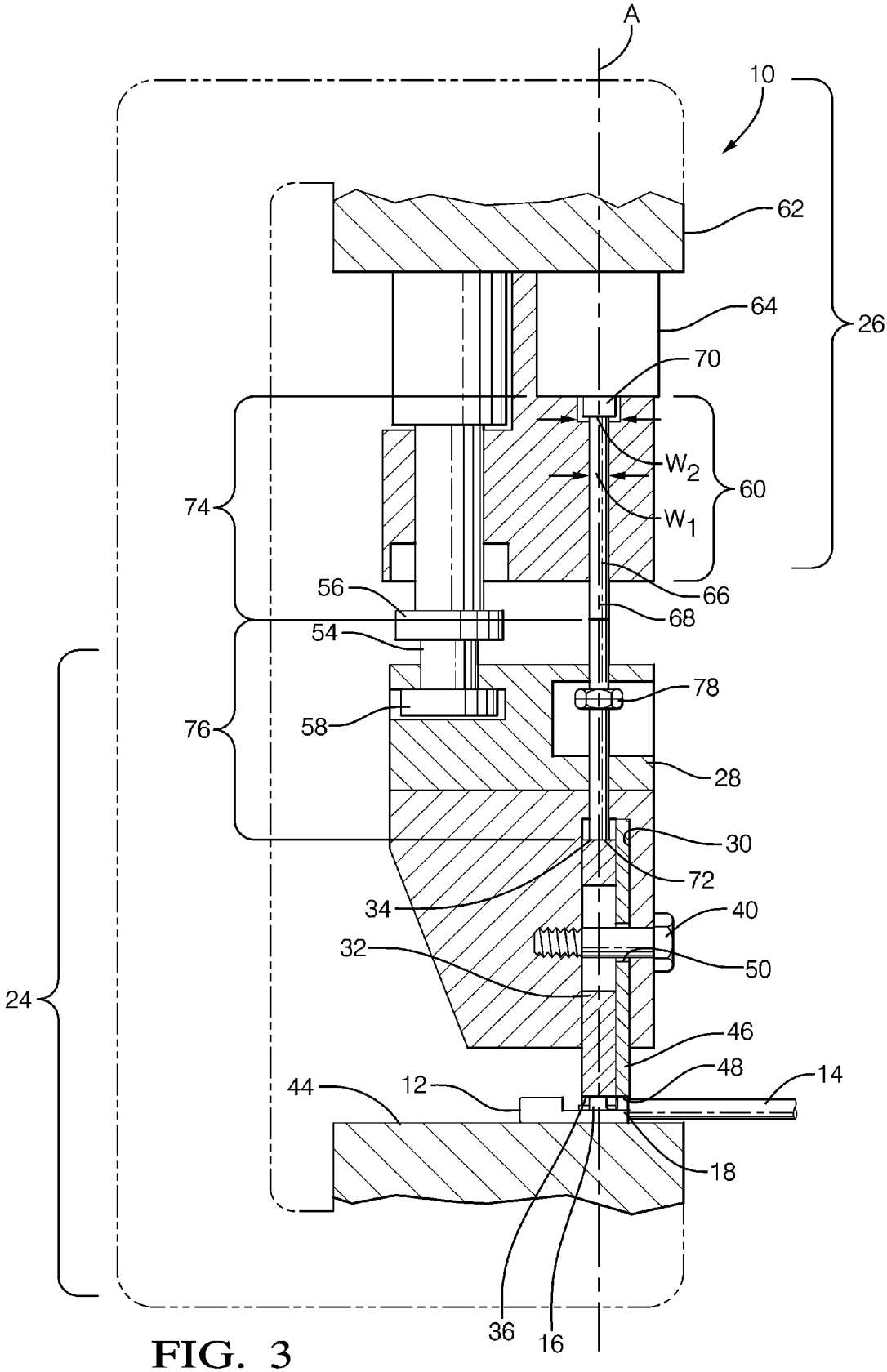
FIG. 3 shows a cross section view of the crimping apparatus in FIG. 2 applying the press force and the separately applying the core crimp force to the load pin and core plate and the core plate engages the wire conductor disposed in the terminal.

Core plate 32 has a slot 38 intermediate first core plate end 34 and second core plate end 36. A fastener 40 is disposed in slot 38 to secure core plate 32 in cavity 30 such that core plate has independent movement in cavity 30 about fastener 40 along slot 38 parallel to length L of core plate 32, but not along width W or thickness T. Preferably, the fastener is a bolt having screw threads that are secured into a threaded hole in the die. Second core plate end 36 of core plate 32 includes a cutout 42. The cutout is configured to provide the necessary shape to form the core crimp portion when the core crimp force is applied from the ram assembly. Terminal 12 and wire conductor 14 are disposed on a terminal plate pad 44 underlying core plate 32 and an insulation plate 46. Exposed wire portion 20 is disposed in first terminal portion 16 and underlies the second core plate end 36 and insulated wire portion 22 is disposed in the second terminal portion 18 that underlies an insulation plate end 48 of insulation core plate 46. Referring to FIG. 3, insulation plate end 48 is adjacent second core plate end 36.

Insulation plate 46 is adjacent core plate 32 in cavity 30 of die assembly 24. Similar to the core plate, the insulation plate about fits the cavity along a width and a thickness of the insulation plate. Insulation plate 46 defines a hole 50. Fastener 40 is disposed in hole 50 of insulation plate 46 to secure insulation plate 46 in cavity 30. Hole 50 is large enough to allow passage of fastener 40, but not so large as to allow substantial movement of insulation plate 46 about hole 50 with application of the insulation crimp force. Fastener 40 is utilized to secure both core plate 32 and insulation plate 46 in die 28. A component of the press force applied as the insulation crimp force applied through insulation plate 46 produces the insulation crimp portion of insulated wire portion 22 disposed in second terminal portion 18. The length, width, and thickness of the insulation plate is similar to that of the core plate. Insulation plate 46, similar to core plate 32, includes a cutout 52. Cutout 52 is disposed on an insulation plate end 49 and is proximate to second core plate end 36. The cutout in the insulation plate has a similar function as the cutout in the core plate and is used to configure the insulation crimp portion of the terminal to the wire conductor when the crimp force is applied to the die assembly. Insulation plate 46 does not have substantial movement in cavity 32 of die 28 during the crimping cycle of the apparatus.

Alternately, a spacer intermediate the core plate and the insulation plate is suitable to space apart the core plate from the insulation plate in the cavity and is dependent on the distance needed between the core crimp portion and the insulation crimp portion to connect the terminal to the wire conductor. The spacer has similar dimensions to that of the core plate and insulation plate. The spacer defines a hole, similar to that of insulation plate and having a similar hole dimension. The spacer is secured to the die by the fastener disposed in the hole of the spacer along with the core plate and the insulation plate. It is desirable to have the spacer fit the cavity so as to not have substantial independent movement of the spacer in the cavity of the die assembly during the crimping cycle, similar to that of the insulation plate.

Die assembly 24 further includes a nail head 54 in force connection with ram assembly 26. A first portion 56 of nail head 54 is supported in ram head 60 and a second portion 58 of nail head 54 is supported in die 28. Nail head 54 transmits the press force supplied from ram assembly 26 to die assembly 24, but does not include transmission of the core crimp force. The die is constructed to help support and provide structural integrity to the core plates, insulation plate, and the nail head in the die assembly of the crimping apparatus during the crimping cycle and when no press force is applied.

Ram assembly 26 includes a ram 62, a sensor or load cell 64, and a load pin 66, and the ram head 60. Ram 62 supplies the press force to die assembly 24 in apparatus 10. Load cell 64 is secured to ram 62, preferably by a bolt (not shown) disposed in ram 62 that threads into load cell 64. Load cell 64 senses the core crimp force applied to the core crimp portion. The ram head is constructed to help support and provide structural integrity to the load cell, load pin, and nail head in the ram assembly of the crimping apparatus during the crimping cycle and when no press force is applied.

Preferably, the load cell is a piezoelectric design where the applied core crimp force is sensed and an electrical output (not shown) is produced. Electrical output (not shown) is a voltage having a value proportional to the applied core crimp force. The electrical output of the load cell may be measured and evaluated in the apparatus or remote from the apparatus. A suitable load cell element is commercially available from Kistler under the trade name designation #9219 Piezoelectric Transducer.

Load pin 66 includes a shaft 68 having a longitudinal axis A. Pin 66 has a first pin end 70 and a second pin end 72 remote from first pin end 70. Shaft 68 has a first width $W_1$ and the first pin end 70 has a second width $W_2$ and the second width $W_2$ is greater than first width $W_1$. Pin 66 is supported in apparatus 10 by the design of ram head 60 around first pin end 70. Pin 66 is connected to load cell 64, preferably with a threaded hex bolt secured to the load cell at the first pin end. Second pin end 68 extends away remote from ram assembly 26 into ram head 60 and into die assembly 24. Second pin end 72 is proximate to first core plate end 34. Core plate 32 is in force connection with pin 66.

Alternately, if the load cell secured to the ram is not used, the pin is configured to be in direct connection with the ram.

Ram 62, load cell 64, pin 66, and core plate 32, and core crimp portion are axially aligned along axis A. Core plate 32 extends axially in die assembly 24 along the length L of core plate 32. Core plate 32 has axial movement in die 28 along slot 38. The independently moving core plate does not require a lubricant to assist, or enable axial movement in the cavity during the crimping cycle.

Load pin 66 further includes a first pin portion 74 that is in force connection and in proximity to a second pin portion 76. First pin portion 74 is independent of second pin portion 76. Ram assembly 26 includes first pin portion 74 and die assembly 24 includes second pin portion 76. Ram assembly 26 is independent form die assembly 24, such that die assembly 24 along with second pin portion 76, may be removed from ram assembly 26 of apparatus 10. For example, latches (not shown) on the die assembly connecting the die assembly to the ram assembly may be unlatched, allowing the die assembly to be pulled out and away from the apparatus. Removal of the die assembly allows usage of the die assembly in a different apparatus. When die assembly 24 is replaced into apparatus 10, second pin portion 76 returns to be axially aligned with first pin portion 74.

Figure 4:
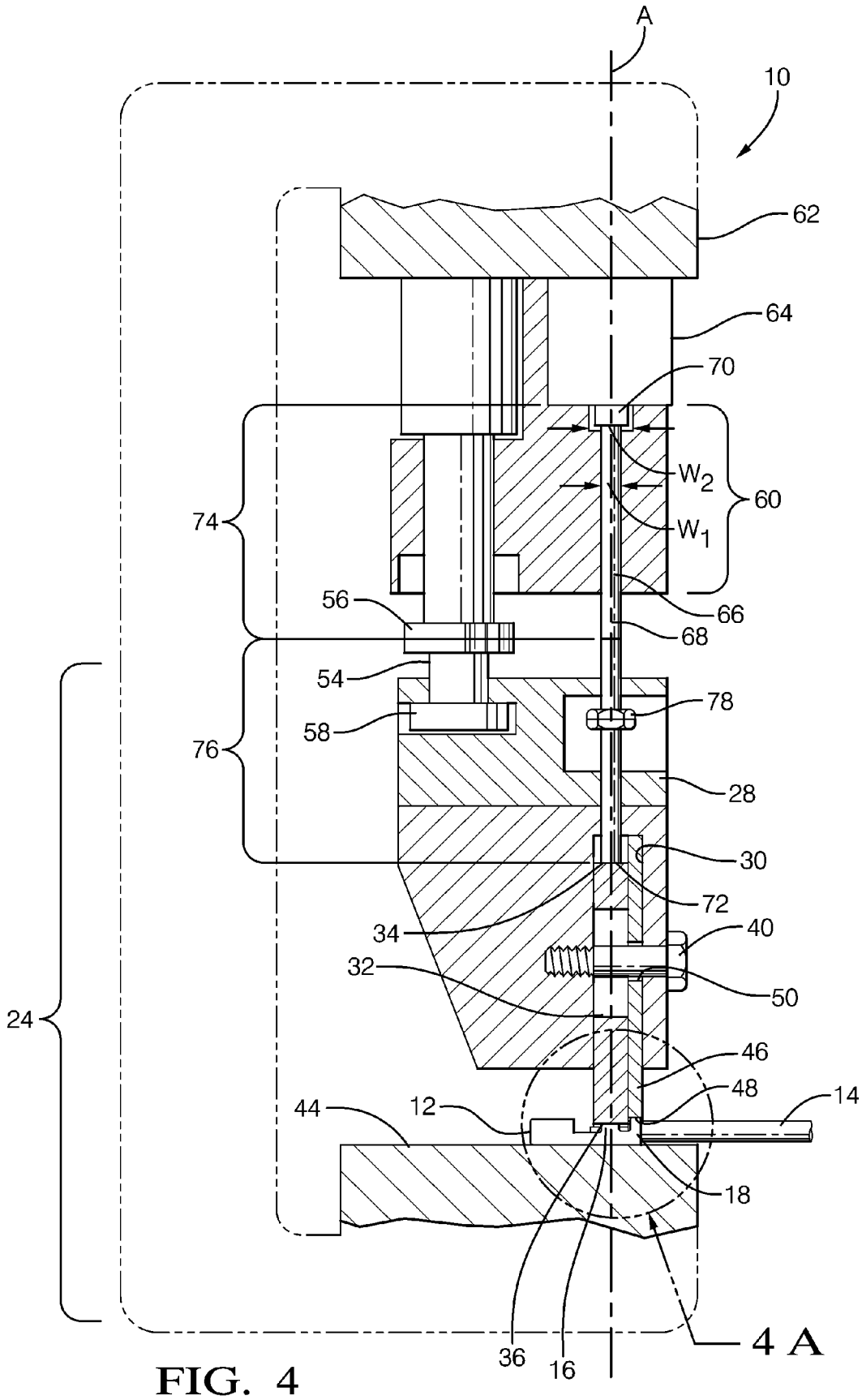
FIG. 4 shows a cross section view of the crimping apparatus in FIG. 3 and the core crimp force produces the core crimp portion connecting the wire conductor to the terminal.
Figure 4A:
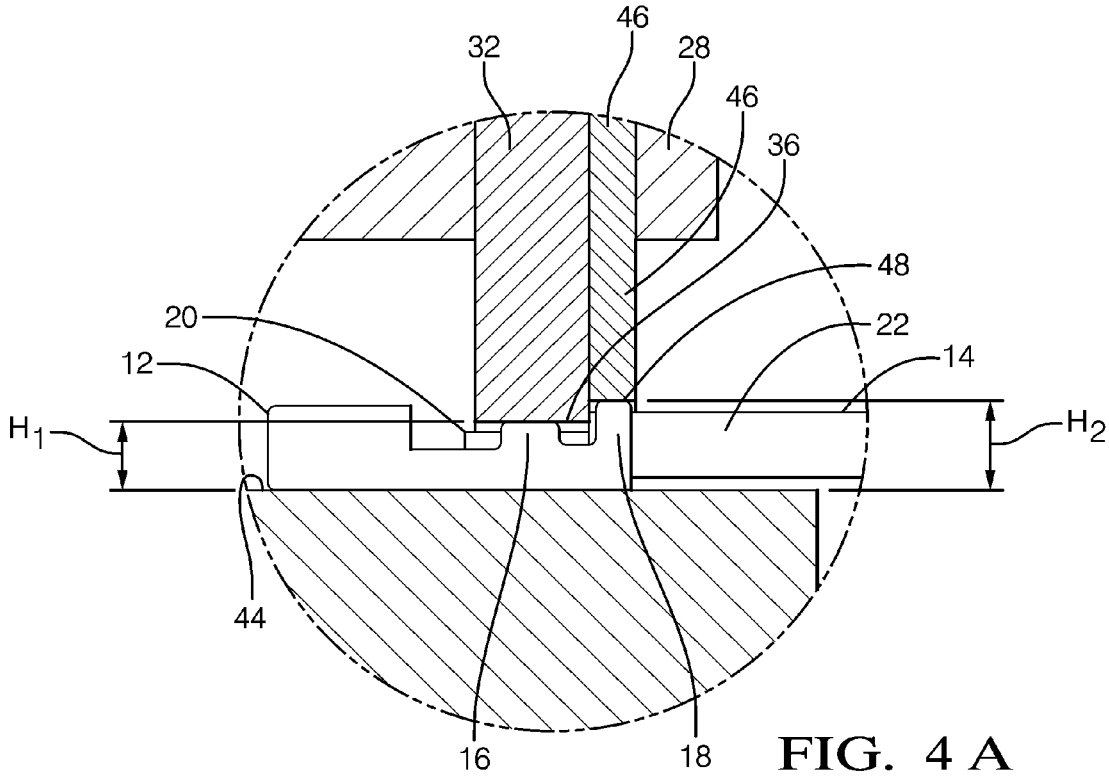
FIG. 4A shows a magnified view of the core crimp force producing the core crimp portion connecting the wire conductor to the terminal of the crimping apparatus in FIG. 4.

Referring to FIG. 4A, a first crimp height $H_1$ of the core crimp portion of first terminal portion 16 crimped to exposed wire portion 20 is adjustable by a first crimp height means 78. A second crimp height $H_2$ of the insulation core crimp portion of second terminal portion 18 is adjustable by a second crimp height means (not shown). First crimp height $H_1$ is independent from the second crimp height $H_2$. The crimp heights may be adjusted to allow for differences in terminals and wire conductors being crimped. The crimp heights may be adjusted during the set-up of the crimping apparatus to ensure the core crimp portion and the insulation core crimp portion meet acceptable quality requirements for a given wire conductor and corresponding terminal.

For example, as shown in FIG. 2, first crimp height means 78 may be adjusted by hex nuts located on pin 66 that adjust pin 66 axially along axis A to raise and lower first crimp height $H_1$. Alternately, first crimp height means may be suitably adjusted by utilizing a pair of triangular wedges intermediate the core plate and second end portion of the pin. One of the wedges may be adjusted to raise and lower the first crimp height $H_1$. The second crimp height means (not shown) may use similar methods as first crimp height means to adjust second crimp height $H_2$. Decreased crimp heights may be needed when the terminals are made of light material, such as aluminum, as less core crimp force is needed to connect the terminal to the wire conductor. Increased crimp heights may be needed when the terminals are made of heavier material, such as steel, as more core crimp force is needed to connect the terminal to the wire conductor. Additionally, different crimp heights are needed when the size of the core crimp portion is different from that of the insulation crimp portion due to the type of wire conductor or terminal being used. For instance, some terminals may have wing structures that allow a large core crimp portion or insulation crimp portion to be produced.

First crimp height means 78 is also effective for adjustment of first pin portion 74 in relation to second pin portion 76 to achieve force connection between pin portions 74, 76 when die assembly 24 is replaced back into apparatus 10. Referring to FIG. 2, the first pin portion may be adjusted to about touch the second pin portion.

When not in operation, referring to FIG. 2, apparatus 10 does not apply the press force and gravity pulls down core plate 32 to rest on fastener 40 restrained by slot 38 that is closest to load pin 66. First pin portion 74 aligned with second pin portion 76 may not touch second pin portion 76 as second pin portion 76 is pulled down by gravity to rest on and touch first core plate end 34.

In operation, referring to FIG. 3, ram 62 of ram assembly 26 of apparatus 10 applies the press force to die assembly 24. The press force is applied to die assembly 24 through nail head 54 and a part of press force is separately applied axially along axis A as the core crimp force from ram 62 to load cell 64 to load pin 66. As the core crimp force is applied, first pin portion 74 contacts second pin portion 76 and moves second pin portion 76 to contact first core plate end 34. Second core plate end 36 then engages terminal plate pad 44 and exposed wire portion 20 disposed in first terminal portion 16 therebetween to produce the core crimp portion crimping the terminal to the wire conductor. Because of slot 38 in core plate 32, core plate 32 moves independently in cavity 30 dependent on the dynamics of the applied core crimp force. The independent movement of core plate 32 allows the core crimp force to be applied separate from the press force and other force components of the press force in apparatus 10.

The applied core crimp force that produces the core crimp portion is then subsequently transferred in a axial direction opposed to the applied core crimp force and away from the core crimp portion. The applied core crimp force is axially transferred from the core crimp portion to core plate 32 to load pin 66 to load cell 64. The load cell senses the applied core crimp force. Referring to FIG. 4, it should be understood that when the core crimp force is transferred from the core crimp portion to core plate 32 to load pin 66, to load cell 64 that the core crimp portion is in contact with second core plate end 36 and first core plate end 34 is in contact with second pin portion 76 and second pin portion 76 is in contact with first pin portion 74 which is in contact with load cell 64.

As the core crimp force produces the core crimp portion, the insulation core crimp force is applied to produce an insulation core crimp portion that connects second terminal portion 18 to insulated wire portion 22.

The core crimp force is separately applied apart from the press force, the remaining component forces of the press force, and the force noise during the crimping cycle. The core crimp force is also sensed apart from the other structure of the crimping apparatus with substantially no loss of the core crimp force to the structure of the crimping apparatus during the transfer from the core crimp portion to the load cell.

The measurement of the core crimp force data sensed by the load cell may be recorded and evaluated to render a quality decision on the core crimp portion. The core crimp force measurement data may be evaluated by a processor on the apparatus or remote from the apparatus. The quality defects of a wire strand missing in the core crimp portion and wire insulation contained in the core crimp portion are important to detect to ensure that the mechanical and electrical integrity of the crimp connection of the terminal to the wire conductor is not impaired. Because smaller gauge wire of less than 20 gauge includes wire strands having a smaller cross sectional area than similar strands of larger gauge wire, detecting the quality defect of a strand of wire conductor missing from the core crimp portion becomes increasingly difficult. An undetected core crimp portion that is defective may produce an undesired effect of downstream quality issues when the terminal connected to the wire conductor is manufactured into a wiring harness.

Typically, the press force applied to crimp a terminal to a wire conductor of less than 20 gauge is in a range of 4500 to 5000 Newtons. In comparison, the core crimp force to crimp a terminal to a wire conductor of a size of 20 gauge or less is about 3600 to 4000 Newtons. Detecting a defective core crimp portion from an acceptable core crimp portion by measuring the press force in a 26 gauge wire conductor in a 26 gauge terminal yielded a 29.3 Newton nominal force delta with the defective nominal force curve being lower than the acceptable nominal force curve. The defective core crimp portion has one missing wire strand missing from the core crimp portion.

Figure 6:
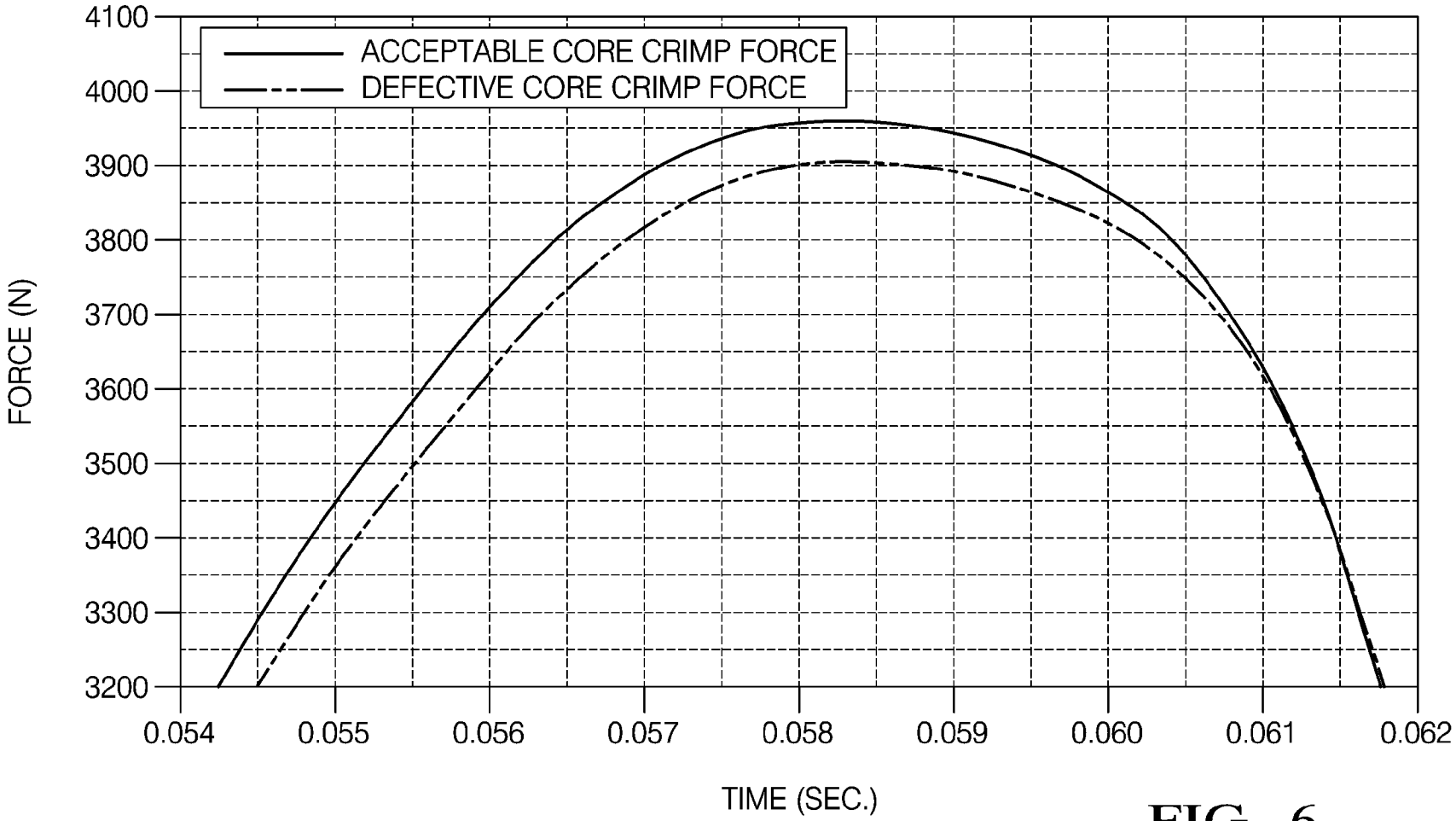
FIG. 6 shows a graph of a force signature of an acceptable core crimp portion versus a force signature of a defective core crimp portion as applied by the crimping apparatus of FIG. 4.

Referring to FIG. 6 and according to the invention, a graph shows the nominal average core crimp force of an acceptable core crimp portion versus the nominal average core crimp force of a defective core crimp portion for a 26 gauge terminal connected to a 26 gauge wire conductor using the crimping apparatus. The defective core crimp force is for a wire conductor that has one strand of conductor wire missing in the core crimp portion. The acceptable core crimp portion shows a nominal average core crimp force that is about 75 Newtons greater than the nominal average core crimp force measured for the defective core crimp. Thus, there is a force separation increase of about 40% measuring the quality of a defective core crimp portion using the core crimp force over using the press force. The increased core crimp force separation provided by measuring only the core crimp force provides increased confidence that a measured defective core crimp portion reflects an actual core crimp portion defect in wire conductors having a size less than 20 gauge.

After measurement of the core crimp force and evaluation of the measurement data to render a quality decision of an acceptable core crimp portion or a defective core crimp portion, the terminal may be trimmed from a lead frame, the terminals connected to wire conductors having the acceptable core crimp portions may be separated from terminals connected to wire conductors having defective core crimp portions. Moreover, only the terminals connected to wire conductors having the acceptable core crimp portions may be used in a later manufacturing operation to construct a wire harness.

Alternately, the load cell may be disposed in the die in the die assembly. With the load cell disposed in the die, each die placed in a crimping apparatus would require a load cell if the core crimp force is to be measured.

In a further alternate embodiment, the apparatus may be designed such that the load pin is disposed through an opening in the nail head.

In another alternate embodiment, the insulation core crimp portion may be produced, sensed, and measured in a similar manner to that of the core crimp portion, described herein.

Alternately, if the core crimp force and the insulation core crimp force are sensed and measured in the same crimping apparatus, two sensors are required. One sensor measures the core crimp force and the other sensor measures the insulation core crimp force. The design would require alternation to stagger the sensors due to their physical size while allowing a pin configuration that allows both the core crimp force and the insulation core crimp force to be adequately measured by each respective sensor.

Alternately, additional load cells may be utilized in the crimping apparatus for measurement of the crimp force, terminal pad force, or other forces applied during the crimping operation of the crimping apparatus.

Alternately, the terminal may include a plurality of crimp portions as necessary dependent on the design of the terminal to connect the terminal to the wire and the press may have a plurality of core plates and insulation plates.

In yet a further alternate embodiment, the press force may be measured and the other elements of the press force be subtracted leaving the core crimp force. Because the amount of force noise associated with applying the press force has variation with each application of the press force, obtaining core crimp force data that reliably detects actual core crimp portion defects is not as predictable with this embodiment, especially for defective core crimp portions of terminals connected to wire conductors having a size of less than 20 gauge.

Thus, the invention provides a crimping apparatus, a method of applying a force, and a manufacturing process method where a press force is applied and a portion of the press force is separately applied as a core crimp force to crimp a terminal to a wire conductor. The applied core crimp force is separated from the applied press force in the crimping apparatus to crimp a terminal to a wire conductor by a load pin and an independently moving core plate in a cavity of the die in the die assembly and the remaining components of the press force are applied to the die assembly through the nail head from the ram assembly to the die assembly. The separation of the core crimp force by the load pin and the independently moving core crimp plate allows sensing of the core crimp force apart from the remaining force components that make up the press force. The axial alignment of the crimp portion, the load cell, the load pin, the core plate allow for the core crimp force to effectively applied to and transferred from the core crimp portion to the load cell for measurement. Because of the separately applied and sensed core crimp force, evaluation of the core crimp force measurements allow acceptable core crimp portions to be detected from the defective core crimp portions that include wire strands of wire conductor found in the core crimp portion and insulation found in the core crimp portion, especially for smaller gauge wire conductors having a size of less than 20 gauge disposed in a corresponding terminal. The load cell for sensing the core crimp force is disposed in the ram assembly as opposed to the die assembly that results in a reduced amount of sensors required to measure the core crimp force, decreasing material costs. Each apparatus can utilize multiple dies using only one load cell sensing element. The load pin has a first pin portion included in the ram assembly and a second pin portion in the die assembly and the ram assembly is independent from the die assembly allowing the die assembly along with the second pin portion to be easily removed from the crimping apparatus and be replaced in a different apparatus. A higher core crimp force delta between an acceptable versus a defective core crimp portion over that of measuring the press force provides a higher confidence level that a measured core crimp portion defect reflects an actual core crimp portion defect. Directly measuring the core crimp force provides a higher confidence level of detecting actual core crimp portion defects than measuring the press force and subtracting out the components of the press force leaving the core crimp force, especially for terminals connected to wire conductors having a size of less than 20 gauge.

While this invention has been described in terms of the preferred embodiment thereof, it is not intended to be so limited, but rather only to the extent set forth in the claims that follow.

We claim:

1. A crimping apparatus comprising:

a die assembly including a die defining a cavity, said die including a core plate configured for movement within the cavity, said core plate includes a first core plate end and a second core plate end remote from the first core plate end;

a ram assembly for applying a press force to the die assembly, said ram assembly including a ram and a load pin being in force connection with the ram, and the load pin has a first pin end and a second pin end remote from the first pin end, and the first pin end is disposed proximate to the ram and the second pin end extending away remote from the ram assembly into the die assembly being proximate to the first core plate end, and the core plate being in force connection with the load pin, a wire conductor being disposed in a terminal disposed on a terminal plate pad proximate to the second core plate end, wherein when the press force is applied by the ram the load pin engages the first core plate end and the second core plate end of the core plate moves to engage the terminal plate pad and the wire conductor disposed in the terminal therebetween so that and a part of the press force is separately applied isolated from the applied press force as a core crimp force to produce a core crimp portion that connects the terminal to the wire conductor, whereby the applied core crimp force is transferred from the core crimp portion to the core plate to the load pin into the ram.

2. The crimping apparatus in claim 1, further comprising a sensor that senses only the transferred core crimp force.

3. The crimping apparatus in claim 1, wherein the terminal comprises a first terminal portion and a second terminal portion and the wire conductor comprises an exposed wire portion and an insulated wire portion, and the insulated wire portion includes insulation surrounding the wire conductor, and the exposed wire portion is disposed in the first terminal portion and the insulated wire portion is disposed in the second terminal portion, and applying the crimp force and part of the crimp force is separately applied as the core crimp force producing the core crimp portion connecting the first terminal portion to the exposed wire portion and a part of the crimp force is applied as a core insulation crimp force producing a core insulation crimp portion connecting the second terminal portion to the insulated wire portion.

4. The crimping apparatus in claim 1, wherein a core crimp portion height is adjustable by a core crimp portion height means, and said load pin comprises said core crimp height means.

5. The crimping apparatus in claim 1, wherein the crimping apparatus includes a nail head, and the load pin and the core plate are disposed along a longitudinal axis of the crimping apparatus with said nail head being disposed in said crimping apparatus having a spaced, generally parallel relationship thereto.

6. The crimping apparatus in claim 1, wherein the wire conductor has a size of less than 20 gauge disposed in a corresponding terminal.

7. The crimping apparatus in claim 1, wherein the core crimp force is applied along a first longitudinal axis of the crimping apparatus and the press force is applied along a second longitudinal axis of the crimping apparatus different from the first longitudinal axis.

8. The crimping apparatus in claim 7, wherein the crimping apparatus comprises a nail head, and the first axis has a spaced, generally parallel relationship to the second axis, and the load pin and the core plate are disposed along the first axis and the nail head is disposed along the second axis.

9. A crimping apparatus comprising:

a die assembly including a die defining a cavity, said die including a core plate having independent movement within the cavity, said core plate includes a first core plate end and a second core plate end remote from the first core plate end; and a ram assembly for applying a press force to the die assembly, said ram assembly including a ram and a load pin being in force connection with the ram, and the load pin has a first pin end and a second pin end remote from the first pin end, and the first pin end is proximate to the ram and the second pin end extends away remote from the ram assembly into the die assembly being proximate to the first core plate end, and the core plate being in force connection with the load pin, a wire conductor being disposed in a terminal disposed on a terminal plate pad proximate to the second core plate end; and a sensor that senses the core crimp force, whereupon the press force will be applied by the ram and the load pin will engage the first core plate end and the second core plate end will engage the terminal plate pad and the wire conductor disposed in the terminal therebetween and a part of the press force will be separately applied as a core crimp force and produce a core crimp portion that connects the terminal to the wire conductor, whereby the applied core crimp force is transferred from the core crimp portion to the core plate to the load pin into the ram, and wherein the ram assembly further comprises a load cell being disposed intermediate the ram and the load pin, said first pin end being proximate to the load cell and the second pin end extending into the die assembly remote from the ram assembly, wherein the core crimp force will be applied from the ram to the load cell to the load pin to the core crimp plate and produce the core crimp portion and the core crimp force will be subsequently transferred from the core crimp portion to the core plate to the load pin and into the load cell, and said sensor comprises the load cell.

10. The crimping apparatus in claim 9, wherein the load pin comprises a shaft having a longitudinal axis, and the load cell, the load pin, the core plate, and the core crimp portion are axially aligned, and the core crimp force is axially applied.

11. The crimping apparatus in claim 10, wherein the core plate extends axially in the cavity and has axial independent movement.

12. The crimping apparatus in claim 10, wherein the shaft of the pin has a first width and the first pin end has a second width, said second width is greater than said first width.

13. A crimping apparatus comprising:

a die assembly including a die defining a cavity, said die including a core plate having independent movement within the cavity, said core plate includes a first core plate end and a second core plate end remote from the first core plate end; and a ram assembly for applying a press force to the die assembly, said ram assembly including a ram and a load pin being in force connection with the ram, and the load pin has a first pin end and a second pin end remote from the first pin end, and the first pin end is proximate to the ram and the second pin end extends away remote from the ram assembly into the die assembly being proximate to the first core plate end, and the core plate being in force connection with the load pin, a wire conductor being disposed in a terminal disposed on a terminal plate pad proximate to the second core plate end, whereupon the press force will be applied by the ram and the load pin will engage the first core plate end and the second core plate end will engage the terminal plate pad and the wire conductor disposed in the terminal therebetween and a part of the press force will be separately applied as a core crimp force and produce a core crimp portion that connects the terminal to the wire conductor, whereby the applied core crimp force is transferred from the core crimp portion to the core plate to the load pin into the ram, and wherein the load pin comprises a first pin portion having a first portion end remote from the first pin end and a second pin portion having a second portion end remote from the second pin end, and the first pin portion is independent from the second pin portion, and the first portion end is proximate to the second portion end, and the ram assembly includes the first pin portion and the die assembly includes the second pin portion, and the die assembly is independent from the ram assembly such that the die assembly is removable from the crimping apparatus.

14. A method to apply a core crimp force, comprising:

applying a press force by a crimping apparatus wherein a part of the press force is the core crimp force that is configured for application by the crimping apparatus distinctly apart from the applied press force;

providing a wire conductor disposed in a terminal to the crimping apparatus; and separately applying the core crimp force distinctly apart from the press force to the wire conductor disposed in the terminal to produce a core crimp portion that connects the terminal to the wire conductor.

15. The method in claim 14, further including, transferring only the separately applied core crimp force from said produced core crimp portion through a core plate and through a load pin to a sensor disposed in the crimping apparatus.

16. The method in claim 15, wherein the crimping apparatus includes the load pin and a ram, the method further including, sensing only the applied core crimp force by the sensor disposed in the ram in direct communication with the load pin.

17. The method in claim 14, further including, adjusting a core crimp portion height of the core crimp portion by a core crimp portion height means disposed on a load pin of the crimping apparatus, wherein said load pin is in communication with the core plate.

18. The method in claim 14, wherein the step of providing the terminal and the wire conductor further includes the wire conductor having a size of less than 20 gauge provided with a corresponding terminal.

19. The method in claim 14, wherein the crimping apparatus comprises:

a die assembly including a die defining the cavity, said die including a core plate configured for movement within the cavity, said core plate includes a first core plate end and a second core plate end remote from the first core plate end;

a ram assembly for applying the crimp force to the die assembly, said ram assembly including a ram and a load pin being in force connection with the ram, and the load pin has a first pin end and a second pin end remote from the first pin end, and the first pin end proximate to the ram and the second pin end extending away remote from the ram assembly into the die assembly being proximate to the first core plate end, and the core plate being in force connection with the load pin, the wire conductor being disposed in the terminal disposed on a terminal plate pad proximate to the second core plate end, wherein when the press force is applied by the ram the load pin engages the first core plate end and the second core plate end of the core plate moves to engage the terminal plate pad and the wire conductor disposed in the terminal therebetween so that a part of the press force is separately applied isolated from the applied press force as the core crimp force to produce a core crimp portion that connects the terminal to the wire conductor, and the applied core crimp force is transferred from the core crimp portion to the core plate to the load pin into the ram.

20. The method in claim 14, wherein the crimping apparatus comprises a core crimp plate that transfers said applied core crimp force.

* * * * *